United States Patent [19]

McMills et al.

[11] Patent Number: 4,674,818

[45] Date of Patent: Jun. 23, 1987

[54] METHOD AND APPARATUS FOR SEALING A COAXIAL CABLE COUPLING ASSEMBLY

[75] Inventors: Corey J. McMills, Los Altos; John S. Mattis, Sunnyvale; James C. Milroy, Palo Alto, all of Calif.

[73] Assignee: Raychem Corporation, Menlo Park, Calif.

[21] Appl. No.: 778,168

[22] Filed: Sep. 18, 1985

Related U.S. Application Data

[63] Continuation of Ser. No. 663,807, Oct. 22, 1984, abandoned.

[51] Int. Cl.[4] ..... H01R 4/00

[52] U.S. Cl. ..... 439/275; 439/578; 439/750

[58] Field of Search ..... 339/94, 177, 59 R, 59 M, 339/61 R, 61 M, 63 R, 63 M, 213 R; 29/828; 381/DIG. 10

[56] References Cited

U.S. PATENT DOCUMENTS

| | | | |
|---|---|---|---|
| 3,103,400 | 9/1963 | Gaither | 339/61 R |
| 3,471,824 | 10/1969 | Greulich et al. | 339/61 R |
| 3,603,912 | 9/1971 | Kelly | 339/89 C |
| 3,668,612 | 6/1972 | Nepovin | 339/177 R |
| 4,234,218 | 11/1980 | Rogers | 285/381 |
| 4,422,710 | 12/1983 | Perona | 339/89 M |
| 4,433,889 | 2/1984 | Ratchford | 339/94 M |
| 4,447,103 | 5/1984 | Werth et al. | 339/94 M |

*Primary Examiner*—Gil Weidenfeld
*Assistant Examiner*—David Pirlot
*Attorney, Agent, or Firm*—Dennis E. Kovach; Ira D. Blecker

[57] ABSTRACT

A hollow, cylindrically shaped, elastically deformable sealant member is disposed over external threads of a mounting unit, and subsequently a driver element having internal threads matable with the external threads is screwed onto the external threads, an elasticity and inside diameter of the sealant member being such so as to tightly adhere to at least one turn of the external threads and an outer surface of the driver element to provide an environmental seal between the internal and external threads.

3 Claims, 1 Drawing Figure

METHOD AND APPARATUS FOR SEALING A COAXIAL CABLE COUPLING ASSEMBLY

This application is a continuation, of application Ser. No. 663,807, filed Oct. 22, 1984 now abandoned.

BACKGROUND OF THE INVENTION

The present application is an improvement over the invention disclosed and claimed in U.S. Ser. No. 594,628, filed Mar. 29, 1984, entitled "A Mechanical Coupling Assembly and Method of Using Same", assigned to the assignee of the present invention, the disclosure of which is incorporated herein by reference. The '628 application relates to a mechanical coupling assembly for coupling a coaxial cable to a coaxial cable drop wire splice box, and includes a deformable compressive member which seals a space between an outer layer of a coaxial cable being coupled and a connector body disposed over this outer layer. Driver means are used for compressing the deformable compressive member, and the driver means is engagable via threads with a male threaded member extending from the drop wire splice box. Though the deformable compressive member provides an excellent sealing means for preventing moisture ingress into the connection so formed between the outer layer of the cable and the connector body, a problem still exists in the art of sealing the threaded interface between the driver means and the male threaded member extending from the drop wire splice box, which disadvantageously sometimes allows water to enter the coaxial cable.

Prior art methods for solving this problem include forming a circular groove around a portion of external threads of the bolt member extending from the drop wire splice box and placing an O-ring in this groove. According, when the connector body is screw threaded over the bolt member and past the O-ring, the O-ring provides a seal which prevents water from entering the interface between the drive means and the bolt member. This prior art method is disadvantageous since tolerances required for adequately forming the groove so as to provide an acceptable sealant blockage are extremely small, and oftentimes the O-ring does not adequately seal as intended. Also, in some drop wire splice boxes, the bolt member is cast onto the drop wire splice box making the formation of the groove per se extremely difficult let alone any type of groove having very precise tolerances. Furthermore, this construction is of no use for sealing drop wire splice box connections where the drop wire splice box is already in place in the field since it is impractical to form the required groove in the field thereby necessitating that the drop wire splice box be replaced.

SUMMARY OF THE INVENTION

It is an object of the present invention to eliminate the above-noted disadvantages and provide a apparatus and method for sealing a connection between a coaxial cable and a drop wire splice box so as to prevent water ingress into the coaxial cable being terminated.

This and other objects are achieved by providing a hollow, cylindrical, elastically deformable sealant member on external threads of a male threaded member of the drop wire splice box to which a coaxial cable is to be connected, an inside diameter and elasticity of the sealant member being such that part of an inner surface of the sealant member tightly adheres to at least one groove turn of the external threads of the bolt member on which the sealant member is disposed, and another part of the inner surface of the sealant member tightly adheres to an external nut surface of a threaded member integrally connected to the coaxial cable being coupled, which threaded member is screwed onto the bolt member.

DESCRIPTION OF THE PREFERRED EMBODIMENTS

Figure 1:
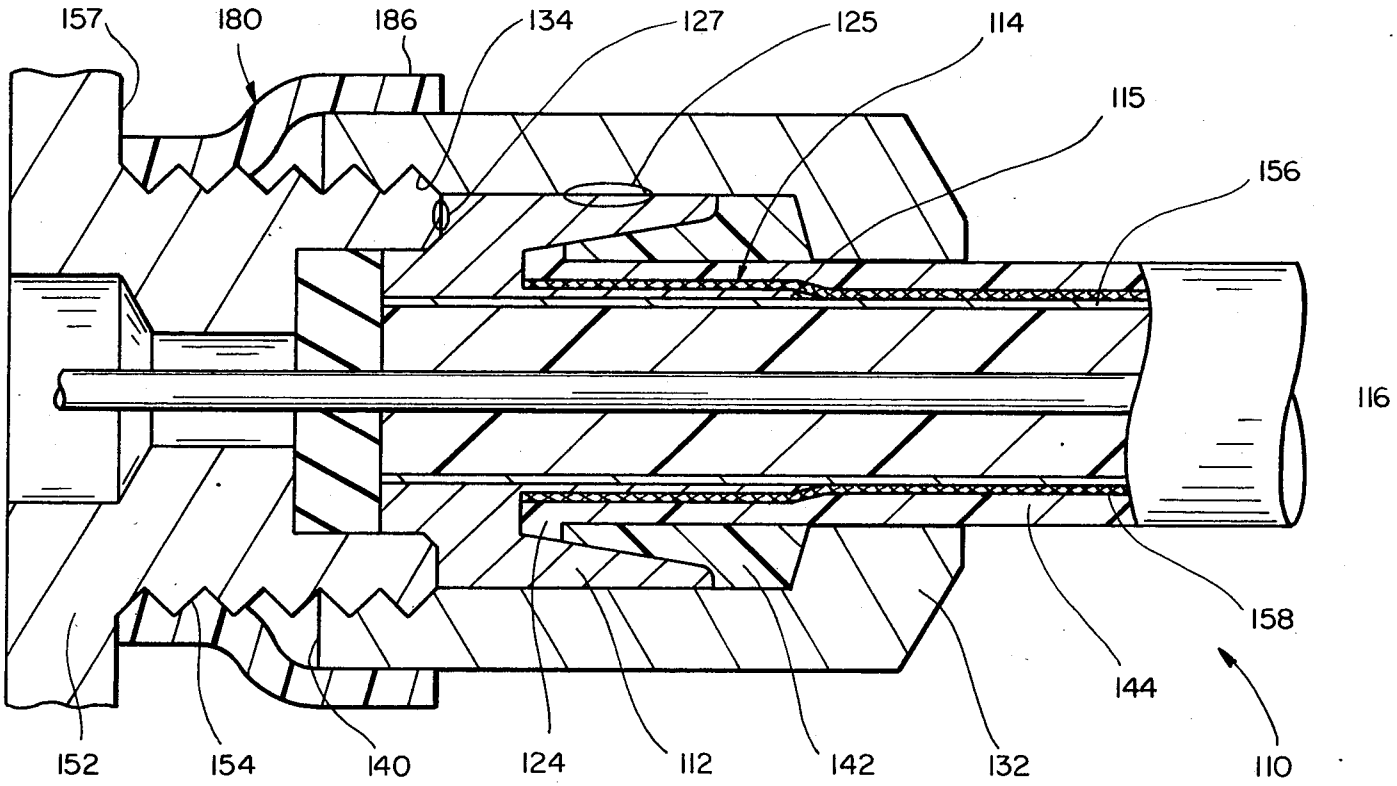
FIG. 1 is an illustration of a first preferred embodiment of the present invention.

The connector of the present invention is especially well-suited for connecting two different types of electrical cables together, a preferred embodiment being for connection of a coaxial cable drop wire to a coaxial cable drop wire box, especially for use with CATV coaxial cables and CATV coaxial drop wire boxes. However, the invention is equally useful in any situation where a cable to be terminated or connected is required to have means for sealing against water ingress at a threaded connection.

Referring to FIG. 1, a coupling 110 includes a connector body 112 having a mating area 114, driver means 132 having threads 134 and a rear face 140, compressive member 142, and a hollow cylindrically shaped elastically deformable sealant member 180. The coupling assembly 110 is connected to a wall mounting unit 152, e.g., a tap box, via a bolt member 152 having external threads 154 engagable with the internal threads 134 of the driver means 132.

According to this embodiment, delicate foil shielding and braided layers 156 and 158 are separated from the cable 116 by the connector body 112 which includes the mating area 114 for contacting the braided layer, the connector body 112 having a distal end 115 which is sharpened to wedge between the delicate foil layer 156 and braided layer 158. The distal end 115 is elongated and sharpened and assures a visual means for the craftsman to assure that the braided layer is, in fact, separated from the foil shield and is being properly positioned on the exterior of portion 115 of the connector body 112, i.e., on mating area 114, as the connector body 112 is being positioned on the cable 116.

The drive means 132 and compressive member 142 are slipped over the cable prior to engaging the distal end 115 into the cable. The drive means 132 is then connected to the wall unit 152 via threads 134 and 154, respectively, and thereby provides the means for urging the connector body 112 and driver means 132 toward each other to deform the compressive member 142. A space created between the driver means 132 and the connector body 112 is occupied by the compressive member 142 as the drive means is tightened which produces a protuberance 124 in cable protective jacket 144 which serves to lock the cable 116 to the body 112 and provides a moisture seal downstream and in series with a path defined by a junction between the connector body 112 and the drive means 132, this path being identified by reference numeral 125.

To prevent moisture from entering the coaxial cable via a path identified by reference numeral 127 defined by a function between the connector body 112 and the mounting unit 152, this path being susceptible to moisture penetration since face 140 of the driver means 132 generally does not bottom on face 157 of the mounting unit which allows moisture to condense and/or collect on the explosed threads 154, a hollow cylindrically shaped elastically deformable sealant member 180 is provided as shown. The sealant member has an inside diameter slightly less than an outside diameter of the external threads 154 of the mounting unit 152 so as to tightly adhere to at least one or more turns of the threads 154 and provides a moisture barrier thereat. Another part of the sealant member 180 is disposed over an external surface of the driver means 132 so as to provide a moisture barrier thereat also.

To provide adequate sealing by the member 180, preferably an elasticity of the material comprising the sealant member is between 10 and 100 durometer, more preferably between 30 and 60, and most preferably between 40 and 50. Suitable materials from which the sealant member preferable are formed are silicone materials which are temperature-stable and stable when exposed to ultraviolet radiation. Other polymers having suitable elasticity values and temperature-stable characteristics can also be used.

As an example, it has been found that a threaded member 152 having an outside diameter of $\frac{3}{8}$ in. at the threaded portion most preferably requires a sealant member 180 having an inside diameter of $\frac{1}{4}$ in. Such a sealant member preferably has an axial length of $\frac{1}{4}$ in.; too short an axial length being disadvantageous since adequate length is not available to adquately seal both the threads 154 and the external surface of the the driver means 132, and too long a length being disadvantageous since buckling of the sealant member on the threads 154 then tends to occur.

According to a preferred embodiment, the sealant member is first disposed over the threads 154 prior to engaging the threads with the driver means 132, thereafter the driver means is threaded onto the threads 154, and the softness and elasticity of the sealant member 180 are such that an end 186 of the sealant member is caused to ride over the external surface of the driver means 132 confronting the face 157 of the mounting unit 152, and preferably is carried to ride over a nut surface of the driver means 132.

Though the invention has been described by reference to a connector in which a coaxial CATV drop wire is connected to a CATV coaxial drop wire splice box via mounting unit 152 having external threads 154 thereon, it is readily apparent that the sealant member 180 can equally be used in any situation where cable is being connected by threadably engaging means to any kind of structure for sealing a path defined between the engaging threads, and accordingly the invention should not be limited by the description of the preferred embodiments disclosed herein, but only by the appended claims.

What is claimed is:

1. A connector for connecting a first coaxial cable to a coaxial cable box, the coaxial cable box having a first threaded member for receiving the first coaxial cable, said first threaded member having external threads on an outer surface thereof, comprising:

a second threaded member connected to said first coaxial cable and having internal threads therein matable with said external threads of said first threaded member of said coaxial cable box;

a hollow, cylindrically shaped, elastically deformed sealant member disposed on some of said external threads and on an external surface of said second threaded member;

said sealant member having an unstretched substantially uniform inside diameter which is less than an outside diameter of both said first and second threaded members, said sealant member having an elasticity such that part of an inner surface thereof substantially fills and tightly contacts at least one groove turn of said external threads on which said sealant member is disposed and such that another part of said internal surface of said sealant member tightly contacts an external nut surface of said second threaded member.

2. The connector as claimed in claim 1, said coaxial cable being a CATV coaxial drop wire, said box being a CATV coaxial cable drop wire box.

3. A method for sealing a connection between a coaxial cable and a mounting unit therefore, comprising the steps of:

disposing a hollow, cylindrically shaped, elastically deformable sealant member over external threads of said mounting unit; and screwing a threaded member having internal threads matable with said external threads over said external threads of said mounting unit, said sealant member having an unstretched substantially uniform inside diameter which is less than an outside diameter of both the external threads and an external nut surface of said threaded member, an elasticity of said sealant member being such that said sealant member tightly adheres to at least one turn of said external threads and to said external nut surface of said threaded member.

* * * * *

US004674818B1

REEXAMINATION CERTIFICATE (2364th)

United States Patent [19]

McMills et al.

[11] B1 4,674,818

[45] Certificate Issued Aug. 30, 1994

[54] METHOD AND APPARATUS FOR SEALING A COAXIAL CABLE COUPLING ASSEMBLY

[75] Inventors: Corey J. McMills, Los Altos; John S. Mattis, Sunnyvale; James C. Milroy, Palo Alto, all of Calif.

[73] Assignee: Raychem Corp., Menlo Park, Calif.

Reexamination Request:
No. 90/003,218, Oct. 8, 1993

Reexamination Certificate for:

| | |
|---|---|
| Patent No.: | **4,674,818** |
| Issued: | **Jun. 23, 1987** |
| Appl. No.: | **778,168** |
| Filed: | **Sep. 18, 1985** |

Related U.S. Application Data

[63] Continuation of Ser. No. 663,807, Oct. 22, 1984, abandoned.

[51] Int. Cl.[5] ..... H01R 9/07

[52] U.S. Cl. ..... 439/275; 439/578; 439/750

[58] Field of Search ..... 439/578–585, 439/675, 271–283

[56] References Cited

U.S. PATENT DOCUMENTS

| | | | |
|---|---|---|---|
| 4,583,811 | 4/1986 | McMills | 339/177 R |
| 4,648,684 | 3/1987 | Mattis et al. | 339/177 R |
| 4,650,228 | 3/1987 | McMills et al. | 285/381 |

OTHER PUBLICATIONS

*Cable TV Supply Co., Inc.* Catalog, Copyright Mar. 31, 1977.

*Electronic Engineers Master Catalog,* EEM 83–84, vol. 2, Copyright 1983, pp. 3, 1781 and 1783.

*Manual of Tetraseal Design,* Copyright 1977, Goshen Rubber Company, Inc.

*RMS Electronics Product Data Sheets,* Copyright 1977, RMS Electronics, Inc., pp. 125–146.

*Magnavox CATV Systems, Inc.* catalog, copyright 1979.

*Primary Examiner*—David Pirlot

[57] ABSTRACT

A hollow, cylindrically shaped, elastically deformable sealant member is disposed over external threads of a mounting unit, and subsequently a driver element having internal threads matable with the external threads is screwed onto the external threads, an elasticity and inside diameter of the sealant member being such so as to tightly adhere to at least one turn of the external threads and an outer surface of the driver element to provide an environmental seal between the internal and external threads.

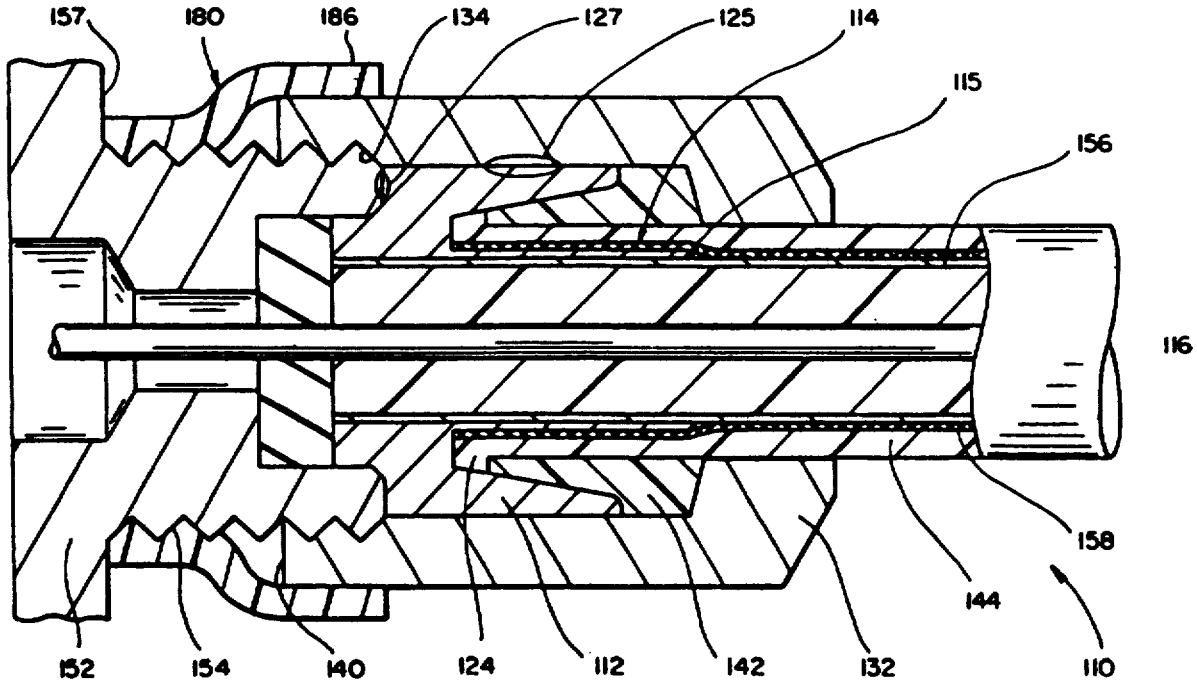

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-3 is confirmed.

* * * * *